US008303677B2

(12) United States Patent
Okada et al.

(10) Patent No.: US 8,303,677 B2
(45) **Date of Patent: *Nov. 6, 2012**

(54) INDOOR UNIT OF AIR CONDITIONER

(75) Inventors: Morimichi Okada, Osaka (JP); Yoshiteru Nouchi, Osaka (JP); Tetsuya Morizane, Osaka (JP)

(73) Assignee: Daikin Industries, Ltd., Osaka (JP)

( * ) Notice: Subject to any disclaimer, the term of this patent is extended or adjusted under 35 U.S.C. 154(b) by 195 days.

This patent is subject to a terminal disclaimer.

(21) Appl. No.: 12/523,033

(22) PCT Filed: Feb. 8, 2008

(86) PCT No.: PCT/JP2008/000189

§ 371 (c)(1),
(2), (4) Date: Jul. 13, 2009

(87) PCT Pub. No.: WO2008/096553

PCT Pub. Date: Aug. 14, 2008

(65) Prior Publication Data

US 2010/0043362 A1 Feb. 25, 2010

(30) Foreign Application Priority Data

Feb. 9, 2007 (JP) ..... 2007-030539

(51) Int. Cl.
*B01D 46/04* (2006.01)

(52) U.S. Cl. ..... 55/289; 55/295; 55/296; 55/429

(58) Field of Classification Search ..... 62/59.1–263, 62/298–303, 317–319; 165/95; 55/289, 55/385.2, 428, 429, 466, 471, 478, 282.2, 55/295–300

See application file for complete search history.

(56) References Cited

U.S. PATENT DOCUMENTS

| | | | | |
|---|---|---|---|---|
| 3,221,479 | A * | 12/1965 | Moser et al. | 55/296 |
| 5,388,426 | A * | 2/1995 | Wada et al. | 62/263 |
| 5,958,114 | A * | 9/1999 | Sunahara et al. | 96/417 |
| 7,350,371 | B2 * | 4/2008 | Lee et al. | 62/317 |
| 7,544,223 | B2 * | 6/2009 | Oda et al. | 55/289 |
| 7,555,914 | B1 * | 7/2009 | Davis | 62/272 |
| 7,614,246 | B2 * | 11/2009 | Yabu et al. | 62/259.1 |
| 7,909,922 | B2 * | 3/2011 | Jang et al. | 96/405 |
| 7,971,451 | B2 * | 7/2011 | Yabu et al. | 62/419 |
| 8,034,138 | B2 * | 10/2011 | Okada et al. | 55/289 |
| 8,038,517 | B2 * | 10/2011 | Shibuya et al. | 454/187 |
| 8,118,899 | B2 * | 2/2012 | Zhang et al. | 55/283 |

(Continued)

FOREIGN PATENT DOCUMENTS

JP 63-104913 U 7/1988

(Continued)

*Primary Examiner* — Duane Smith
*Assistant Examiner* — Thomas McKenzie
(74) *Attorney, Agent, or Firm* — Birch, Stewart, Kolasch & Birch, LLP

(57) ABSTRACT

An indoor unit (13) of an air conditioner (43) including: a filter member (41) for trapping dust contained in air sucked through an inlet (22); a dust removing means (42) configured to remove the dust trapped on the filter member (41) from the filter member (41); and a dust container (43) for containing the dust removed from the filter member (41) by the dust removing means (42), wherein the indoor unit (13) further includes a container lifting/lowering means (44) for lifting/lowering only the dust container (43) relative to the casing (34).

10 Claims, 8 Drawing Sheets

U.S. PATENT DOCUMENTS

| | | | | |
|---|---|---|---|---|
| 2002/0189274 | A1* | 12/2002 | Lee et al. | 62/298 |
| 2004/0000160 | A1* | 1/2004 | Takashima et al. | 62/317 |
| 2006/0096459 | A1* | 5/2006 | Iwano et al. | 96/224 |
| 2007/0060036 | A1* | 3/2007 | Shibuya et al. | 454/187 |
| 2009/0183471 | A1* | 7/2009 | Shibuya et al. | 55/282.2 |
| 2009/0211284 | A1* | 8/2009 | Yabu et al. | 62/259.1 |
| 2010/0107575 | A1* | 5/2010 | Zhang et al. | 55/289 |
| 2010/0116463 | A1* | 5/2010 | Zhang et al. | 165/95 |
| 2010/0294134 | A1* | 11/2010 | Yokomizo et al. | 96/405 |
| 2010/0323606 | A1* | 12/2010 | Okada et al. | 454/338 |

FOREIGN PATENT DOCUMENTS

| | | | |
|---|---|---|---|
| JP | 11-118183 | A | 4/1999 |
| JP | 2004-84998 | A | 3/2004 |
| JP | 2005-201468 | A | 7/2005 |
| JP | 2006-71121 | A | 3/2006 |

* cited by examiner (A)

(B)

INDOOR UNIT OF AIR CONDITIONER

TECHNICAL FIELD

The present invention relates to an indoor unit of an air conditioner installed on a ceiling.

BACKGROUND ART

An indoor unit of an air conditioner installed on a ceiling has conventionally been known. In the field of the indoor unit of this type, an indoor unit having the function of removing dust trapped on a filter member has been known. Patent Document 1 discloses an indoor unit of this type.

Specifically, the indoor unit of Patent Document 1 includes, as a structure for removing dust on an air filter a drive unit, a rotating brush, a collecting case, and a suction device. The air filter is in the shape of a disc, and traps dust contained in the air flowing into the unit through a suction grille. The air filter is provided with teeth formed on the periphery of a frame thereof. The drive unit includes a gear engaged with the teeth of the frame of the air filter. The rotating brush is configured to remove the dust from the air filter, and is in contact with the air filter at the tip thereof. The collecting case accommodates the rotating brush therein, and collects the dust removed by the rotating brush. The suction device is configured to suck and collect the dust fell in the collecting case.

In this indoor unit, the air filter rotates when the drive unit is operated, and the dust adhered to the air filter is removed by the rotating brush. The dust removed from the air filter falls in the collecting case, and the dust in the collecting case is sucked and collected by the suction device.

In the conventional indoor unit of the air conditioner, it has been known that the filter member is lifted/lowered relative to a casing together with a suction grille member provided on a bottom surface of the casing for easy cleaning of the filter member. The indoor unit of this type is disclosed by, for example, Patent Document 2.

Patent Document 1: Published Japanese Patent Application No. 2006-71121

Patent Document 2: Published Japanese Patent Application No. 2004-84998

DISCLOSURE OF THE INVENTION

Problem that the Invention is to Solve

The conventional indoor unit of the air conditioner which is installed on the ceiling and has the function of removing the dust on the filter member involves work at high elevations in removing the dust accumulated in a dust container. Therefore, heavy labor has been required to remove the dust from the dust container.

In this point of view, the present invention was developed. The present invention is directed to the indoor unit of the air conditioner including a dust removing means configured to remove dust trapped on the filter member from the filter member, and aims to provide a simple structure which allows for the lifting/lowering of the dust container relative to the casing.

Means of Solving the Problem

A first aspect of the invention is directed to an indoor unit of an air conditioner installed on a ceiling including: a casing (34) provided with an inlet (22) and an outlet (23), the indoor unit controlling temperature of air sucked therein through the inlet (22), and blowing the air into a room through the outlet (23); a filter member (41) for trapping dust contained in the air sucked through the inlet (22); a dust removing means (42) configured to remove the dust trapped on the filter member (41) from the filter member (41); a dust container (43) for containing the dust removed from the filter member (41) by the dust removing means (42); and a container lifting/lowering means (44) for lifting/lowering only the dust container (43) relative to the casing (34).

According to a second aspect of the invention related to the first aspect of the invention, the dust container (43), when positioned in the casing (34), exposes a bottom surface thereof in the room from a bottom surface of the casing (34) or a ceiling surface.

According to a third aspect of the invention related to the second aspect of the invention, the inlet (22) is formed in a center of the bottom surface of the casing (34), and the outlet (23) is formed outside the inlet (22). The dust container (43), when positioned in the casing (34), lies between the inlet (22) and the outlet (23).

According to a fourth aspect of the invention related to the third aspect of the invention, the dust container (43) is in the shape of a rectangular frame when viewed from below, and the dust container (43), when positioned in the casing (34), surrounds the inlet (22).

According to a fifth aspect of the invention related to the second aspect of the invention, the dust container (43), when positioned in the casing (34), lies in a center of the bottom surface of the casing (34), and the inlet (22) is formed around the dust container (43).

According to a sixth aspect of the invention related to any one of the first to fifth aspects of the invention, the dust removing means (42) includes a brush member (50) for removing the dust adhered to the filter member (41), and a drive mechanism (60) for moving the brush member (50) or the filter member (41) to remove the dust adhered to the filter member (41), and the drive mechanism (60) is capable of alternatively performing operation of moving the brush member (50) or the filter member (41), and operation of lifting/lowering the dust container (43), and also functions as the container lifting/lowering means (44).

According to a seventh aspect of the invention related to the first aspect of the invention, the indoor unit further includes: a dust transfer path (46, 73) for transferring the dust removed from the filter member (41) by the dust removing means (42) to the dust container (43), wherein the indoor unit is configured to generate a flow of air toward the dust container (43) in the dust transfer path (46, 73), so that the dust removed from the filter member (41) and flowed into the dust transfer path (46, 73) is transferred to the dust container (43).

According to the seventh aspect of the invention, the dust removed from the filter member (41) by the dust removing means (42) is transferred to the dust container (43) through the dust transfer path (46, 73). The removed dust is transferred to the dust container (43) by the flow of air. The dust removed from the filter member (41) does not accumulate at a position where the removal is performed, but is transferred to the dust container (43), and then accumulates therein.

According to an eighth aspect of the invention related to the seventh aspect of the invention, the dust container (43) is arranged in space above the ceiling outside the casing (34).

According to the eighth aspect of the invention, the dust container (43) is arranged in the space above the ceiling outside the casing (34). Therefore, the size of the dust container (43) is not limited by the size of the casing (34).

According to a ninth aspect of the invention related to the seventh or eighth aspect of the invention, the dust container (43) has a top opening formed in a top surface thereof to connect the dust transfer path (46, 73) thereto, and the dust transfer path (46, 73) has an outlet portion made of a tube, and is arranged with the outlet portion facing downward, so that the outlet portion is inserted in the top opening when the container lifting/lowering means (44) lifts the dust container (43), and that the outlet portion is detached from the top opening when the container lifting/lowering means (44) lowers the dust container (43).

According to the ninth aspect of the invention, the outlet portion of the dust transfer path (46, 73) made of the tube is inserted in the top opening when the dust container (43) is lifted. The dust transfer path (46, 73) is automatically connected to the dust container (43) as the dust container (43) is lifted. Thus, the indoor unit (1) is allowed to transfer the dust to the dust container (43) through the dust transfer path (46, 73). On the other hand, when the dust container (43) is lowered, the outlet portion of the dust transfer path (46, 73) is detached from the top opening. The dust transfer path (46, 73) is automatically separated from the dust container (43).

Advantages

According to the first aspect of the invention, the dust contained in the air sucked through the inlet (22) is trapped on the filter member (41), and the dust trapped on the filter member (41) is removed by the dust removing means (42). The dust removed from the filter member (41) by the dust removing means (42) accumulates in the dust container (43). As the amount of the dust accumulated in the dust container (43) increases, removal of the dust in the dust container (43) becomes necessary. According to the first aspect of the invention, the container lifting/lowering means (44) can lift/lower only the dust container relative to the casing (34) so as to remove the dust in the dust container (43). In removing the dust in the dust container (43), only the dust container (43) is lowered from the casing (34) by the container lifting/lowering means (44). Then, after the dust in the dust container (43) is removed, the lowered dust container (43) is lifted toward the casing by the container lifting/lowering means (44).

According to the second aspect of the invention, the dust container (43), when positioned in the casing (34), exposes a bottom surface thereof in the room from a bottom surface of the casing (34) or a ceiling surface. Therefore, the dust container (43) can be lifted/lowered by simply moving the dust container (43) in a vertical direction.

According to the third aspect of the invention, the dust container (43), when positioned in the casing (34), lies between the inlet (22) and the outlet (23). On the bottom surface of the casing (34), the dust container (43) is arranged outside the inlet (22) without the outlet (23) interposed between the dust container (43) and the inlet (22).

According to the fourth aspect of the invention, the dust container (43) is in the shape of a rectangular frame when viewed from below. The dust container (43) is arranged to surround the inlet (22) between the inlet (22) and the outlet (23). According to the fourth aspect of the invention, a region between the inlet (22) and the outlet (23) on the bottom surface of the casing (34) is used to arrange the dust container (43) around the entire circumference of the inlet (22).

According to the fifth aspect of the invention, the dust container (43), when positioned in the casing (34), lies in a center of the bottom surface of the casing (34). On the bottom surface of the casing (34), the inlet (22) is formed around the dust container (43).

According to the sixth aspect of the invention, the drive mechanism (60) for moving the brush member (50) or the filter member (41) to remove the dust adhered to the filter member (41) also functions as the container lifting/lowering means (44). Specifically, the drive mechanism (60) is used not only for moving the brush member (50) or the filter member (41), but also for lifting/lowering the dust container (43).

Effect of the Invention

According to the present invention, only the dust container (34) is lifted/lowered by the container lifting/lowering means (44). That is, only the dust container (34) which is relatively lightweight is lifted/lowered.

In the indoor unit which is configured to lift/lower the suction grille member as disclosed by Patent Document 2, for example, the dust container can be lifted/lowered by integrating the suction grille member and the dust container. However, since the suction grille member is relatively heavy, the integration of the suction grille member and the dust container requires a large-scale mechanism for lifting/lowering the suction grille member and the dust container.

Further, in the indoor unit which is configured to lift/lower the suction grille member as disclosed by Patent Document 2, the suction grille member is generally hung at two points to provide a simple structure. In this indoor unit, when the dust container is lifted/lowered together with the suction grille member, the dust container needs to be arranged, for example, in the center of the suction grille member, so as to prevent inclination of the dust container and dispersion of the dust contained in the dust container during the lifting/lowering of the suction grille member and the dust container. However, this structure may bring about a problem in that the dust container blocks the flow of air sucked through the suction grille member.

Further, when the dust container (43) is arranged at the edge of the suction grille member so as not to block the flow of air sucked through the suction grille member, the suction grille member has to be hung at three or more points to prevent the inclination of the dust container during the lifting/lowering. As a result, the structure for lifting/lowering the suction grille member and the dust container becomes complicated.

In contrast, according to the present invention, the container lifting/lowering means (44) lifts/lowers only the relatively lightweight dust container (43) without accompanied by the relatively heavy suction grille member. Specifically, power required for lifting/lowering the dust container (43) is relatively small. Since only the dust container (43) is lifted/lowered, for example, there is no need of considering members other than the dust container (43) so as to prevent the inclination of the dust container (43) and the dispersion of the dust in the dust container (43) during the lifting/lowering of the dust container (43). Therefore, the structure of the container lifting/lowering means (44) will not be complicated. Thus, a simple structure can be provided that allows for the lifting/lowering of the dust container (43) relative to the casing (34).

According to the second aspect of the invention, the dust container (43) can be lifted/lowered by simply moving the dust container (43) in the vertical direction. This does not require complicated movement of the dust container (43), and therefore, the structure of the container lifting/lowering means (44) is simplified.

According to the third aspect of the invention, the dust container (43) is arranged outside the inlet (22) on the bottom surface of the casing (34) without the outlet (23) interposed between the dust container (43) and the inlet (22). Specifically, the dust container (43) and the inlet (22) are adjacent to each other. Therefore, for example, when the filter member (41) is arranged near the inlet (22), the dust container (43) can be arranged near the filter member (41). Thus, the dust removed from the filter member (41) can easily be guided to the dust container (43).

According to the fourth aspect of the invention, a region between the inlet (22) and the outlet (23) on the bottom surface of the casing (34) is used to arrange the dust container around the entire circumference of the inlet (22). In the indoor unit (13), it is necessary to keep a certain distance between the inlet (22) and the outlet (23) so as to prevent a phenomenon in which the air blown from the outlet (23) is sucked through the inlet (22) (a so-called shortcut phenomenon). According to the fourth aspect of the invention, the region between the inlet (22) and the outlet (23) on the bottom surface of the casing (34) is effectively used to arrange the dust container (43) around the entire circumference of the inlet (22). This structure allows the dust container (43) to have a relatively large volume, and therefore, a larger amount of dust can accumulate in the dust container (43).

According to the fifth aspect of the invention, the inlet (22) is formed in the bottom surface of the casing (34) to surround the dust container (43). Specifically, the dust container (43) and the inlet (22) are adjacent to each other. Therefore, for example, when the filter member (41) is arranged near the inlet (22), the dust container (43) can be arranged near the filter member (41). Thus, the dust removed from the filter member (41) can easily be guided to the dust container (43).

According to the sixth aspect of the invention, the drive mechanism (60) is used not only for moving the brush member (50) or the filter member (41), but also for lifting/lowering the dust container (43). Specifically, there is no need of providing a means for moving the brush member (50) or the filter member (41) and a means for lifting/lowering the dust container (43) separately. Therefore, the structure of the indoor unit (13) can be simplified.

According to the seventh aspect of the invention, the dust removed from the filter member (41) does not accumulate at a position where the removal is performed, but is transferred to the dust container (43), and then accumulates therein. Therefore, even when the dust fills the dust container (43), the dust does not have affect on the suction filter and the dust removing mechanism (42). This structure improves the reliability of the indoor unit (1).

According to the eighth aspect of the invention, the size of the dust container (43) is not limited to the size of the casing (34). Therefore, the dust container (43) can be enlarged.

According to the ninth aspect of the invention, the dust transfer path (46, 73) is automatically detached from the dust container (43) as the dust container (43) is lowered, and is automatically connected to the dust container (43) as the dust container (43) is lifted. Therefore, the lowering of the dust container (43) does not involve a process of detaching the transfer duct (73) from the dust container (43). Further, after the dust container (43) is lifted, there is no need of performing a process of connecting the transfer duct (73) of the dust container (43). This allows for quick and easy lifting/lowering of the dust container (43).

DESCRIPTION OF CHARACTERS

Figure 1:
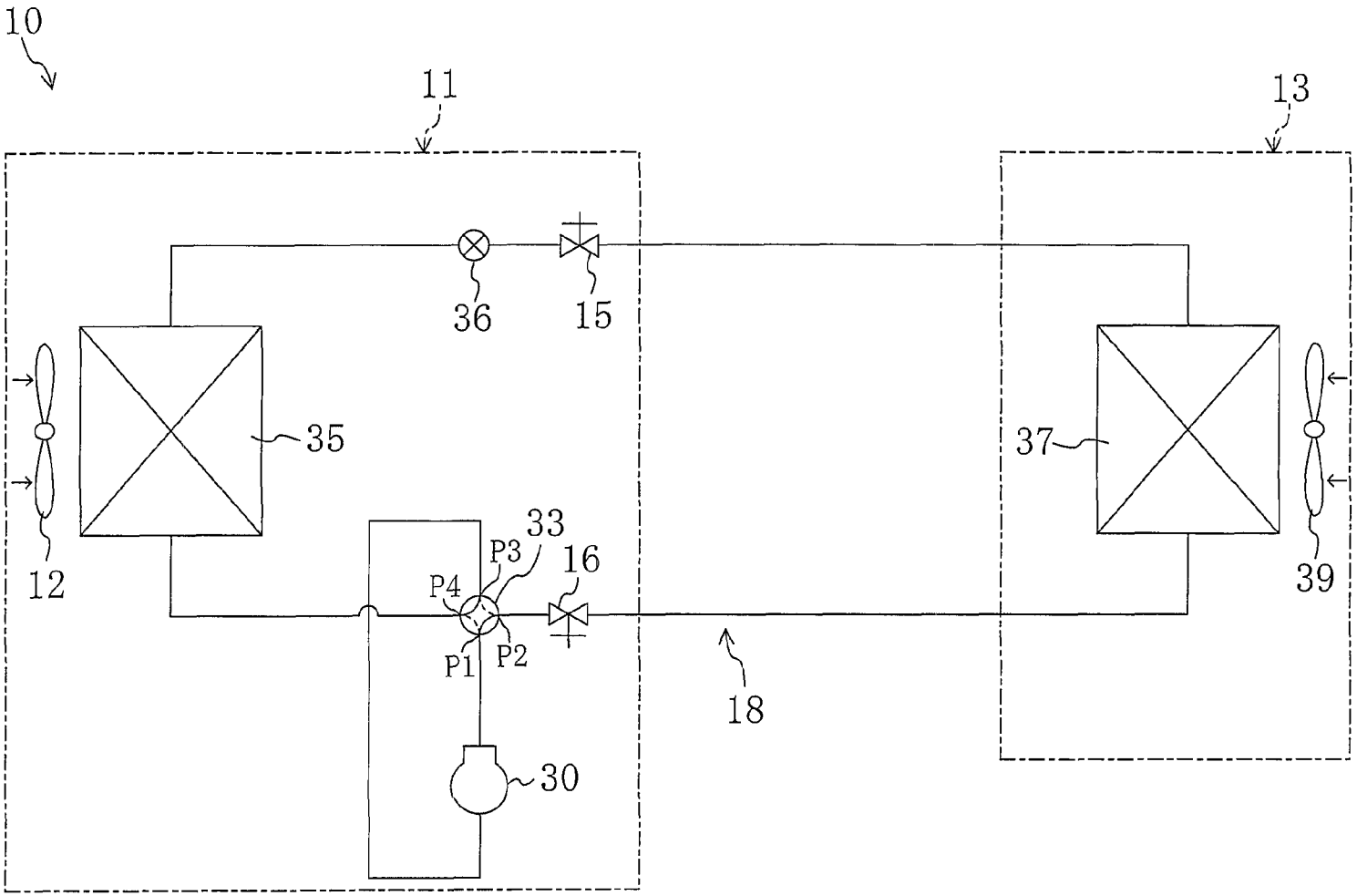
FIG. 1 is a schematic block diagram illustrating a refrigerant circuit of an air conditioner according to an embodiment of the present invention.

10 Air conditioner
13 Indoor unit
22 Inlet
23 Outlet
34 Casing
41 Suction filter (filter member)
42 Dust removing mechanism (dust removing means)
43 Dust container
44 Container lifting/lowering mechanism (container lifting/lowering means)
50 Rotating brush (brush member)
57 Removing motor (drive mechanism)

BEST MODE FOR CARRYING OUT THE INVENTION

Hereinafter, an embodiment of the present invention will be described in detail with reference to the drawings.

The present embodiment is directed to an air conditioner (10) including an indoor unit (13) of the present invention. In this air conditioner (10), the indoor unit (13) is installed on a ceiling in a room. Hereinafter, the air conditioner (10) of the present embodiment will be described first, and then the indoor unit (13) of the present invention will be described.

The air conditioner (10) of the present embodiment includes, as shown in FIG. 1, an outdoor unit (11) and an indoor unit (13). The outdoor unit (11) includes a compressor (30), an outdoor heat exchanger (35), an expansion valve (36), a four-way switching valve and an outdoor fan (12). The indoor unit (13) includes an indoor heat exchanger (37) and an indoor fan (39).

In the outdoor unit (11), a discharge side of the compressor (30) is connected to a first port (P1) of the four-way switching valve (33). A suction side of the compressor (30) is connected to a third port (P3) of the four-way switching valve (33).

The outdoor heat exchanger (35) is configured as a cross-fin type fin-and-tube heat exchanger. One end of the outdoor heat exchanger (35) is connected to a fourth port (P4) of the four-way switching valve (33). The other end of the outdoor heat exchanger (35) is connected to a liquid stop valve (15).

The outdoor fan (12) is arranged near the outdoor heat exchanger (35). In the outdoor heat exchanger (35), outdoor air sent by the outdoor fan (12) and a circulating refrigerant exchange heat. An expansion valve (36) capable of changing the degree of opening is provided between the outdoor heat exchanger (35) and the liquid stop valve (15). A second port (P2) of the four-way switching valve (33) is connected to a gas stop valve (16).

The four-way switching valve (33) is configured to be able to switch between a first state where the first port (P1) and the second port (P2) communicate with each other, and the third port (P3) and the fourth port (P4) communicate with each other (a state indicated by a solid line in FIG. 1), and a second state where the first port (P1) and the fourth port (P4) communicate with each other, and the second port (P2) and the third port (P3) communicate with each other (a state indicated by a broken line in FIG. 1).

In this air conditioner (10), when the compressor (30) is driven, and the four-way switching valve (33) is set to the first state, heating operation is performed. In the heating operation, a vapor compression refrigeration cycle is performed in which the outdoor heat exchanger (35) and the indoor heat exchanger (37) in the refrigerant circuit (18) function as an evaporator and a condenser, respectively. On the other hand, when the compressor (30) is driven, and the four-way switching valve (33) is set to the second state, cooling operation is performed. In the cooling operation, a vapor compression refrigeration cycle is performed in which the outdoor heat exchanger (35) and the indoor heat exchanger (37) in the refrigerant circuit (18) function as a condenser (a radiator) and an evaporator, respectively.

[Structure of Indoor Unit]

Figure 2:
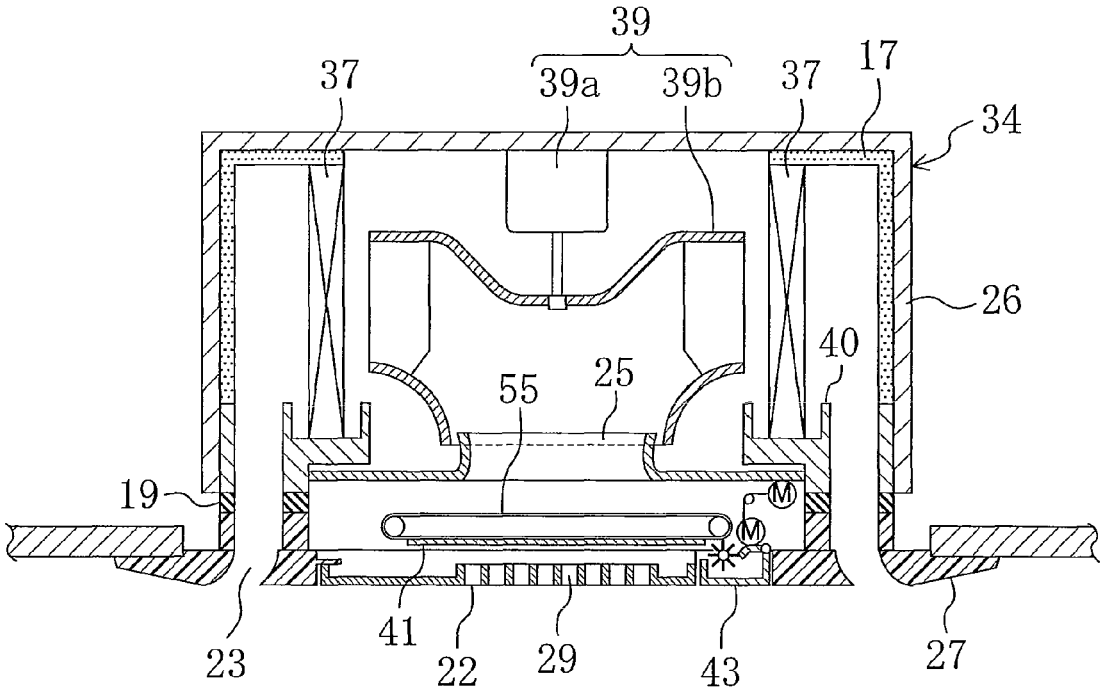
FIG. 2 is a cross-sectional view illustrating an indoor unit according to the embodiment of the present invention.

As shown in FIG. 2, the indoor unit (13) of the present invention includes a casing (34) including a casing body (26) and a decorative panel (27). In the casing (34), are placed the indoor heat exchanger (37), the indoor fan (39), a drain pan (40), a suction filter (41) as a filter member, a dust removing mechanism (42) as a dust removing means, a dust container (43), and a container lifting/lowering mechanism (44) as a container lifting/lowering means.

The casing body (26) is in the shape of a substantially rectangular parallelepiped box having an open bottom. A heat insulator (17) is laminated on an inner surface of the casing body (26). The casing body (26) is arranged so that its lower portion is inserted in an opening in a ceiling board (1).

The decorative panel (27) is in the shape of a rectangular plate. When viewed in plan, the decorative panel (27) is slightly larger than the casing body (26). The decorative panel (27) is attached to the casing body (26) to cover the bottom of the casing body (26) with a sealant (19) sandwiched therebetween. The decorative panel (27), when attached to the casing body (26), is exposed in the room.

Figure 3:
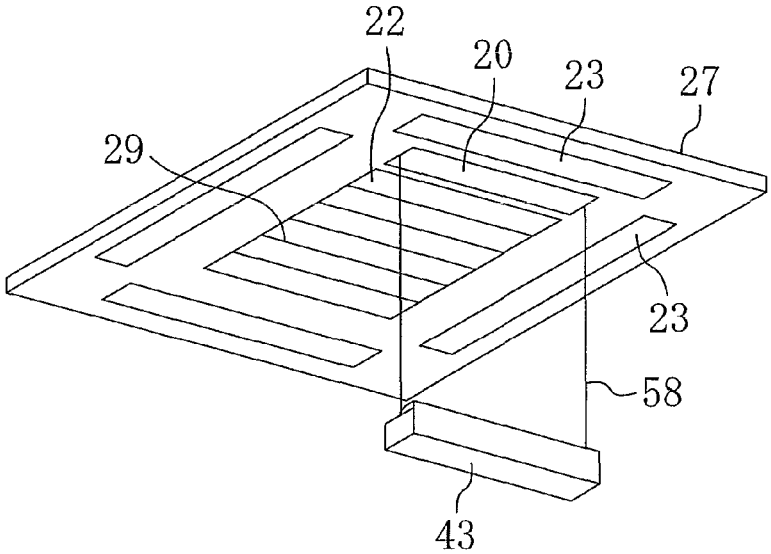
FIG. 3 is a perspective view illustrating a decorative panel according to the embodiment of the present invention as viewed from below.

As shown in FIG. 3, the decorative panel (27) is provided with one inlet (22) and four outlets (23, 23, . . . ). The inlet (22) is rectangular-shaped, and is formed in the center of the decorative panel (27). A suction grille (29) provided with slits is fitted in the inlet (22). Each of the outlets (23) is in the shape of a narrow rectangle. The outlets (23) are formed along the sides of the decorative panel (27), respectively.

On a bottom surface of the decorative panel (27), a container housing part (20) for housing the dust container (43) is opened. An opening of the container housing part (20) is in the shape of a narrow rectangle. The container housing part (20) is formed between one side of the inlet (22) and the outlet (23) facing the side.

The indoor fan (39) is a so-called turbo fan. The indoor fan (39) is arranged near the center of the casing body (26) and above the inlet (22). The indoor fan (39) includes a fan motor (39*a*) and an impeller (39*b*). The fan motor (39*a*) is fixed to a top plate of the casing body (26). The impeller (39*b*) is connected to a rotation axis of the fan motor (39*a*). A bell mouth (25) communicating with the inlet (22) is provided below the indoor fan (39). The indoor fan (39) is configured to blow air sucked from below through the bell mouth (25) in a radial direction.

The indoor heat exchanger (37) is configured as a cross-fin type fin-and-tube heat exchanger. When viewed in plan, the indoor heat exchanger (37) is in the shape of a rectangular frame, and is arranged to surround the indoor fan (39). In the indoor heat exchanger (37), indoor air sent by the indoor fan (39) and a circulating refrigerant exchange heat.

The drain pan (40) is arranged below the indoor heat exchanger (37). The drain pan (40) receives drainage generated as a result of condensation of moisture in the air in the indoor heat exchanger (37). The drain pan (40) is provided with a drain pump (not shown) for discharging the drainage. The drain pan (40) is inclined so that the drainage is collected to part of the drain pan at which the drain pump is provided.

Figure 4:
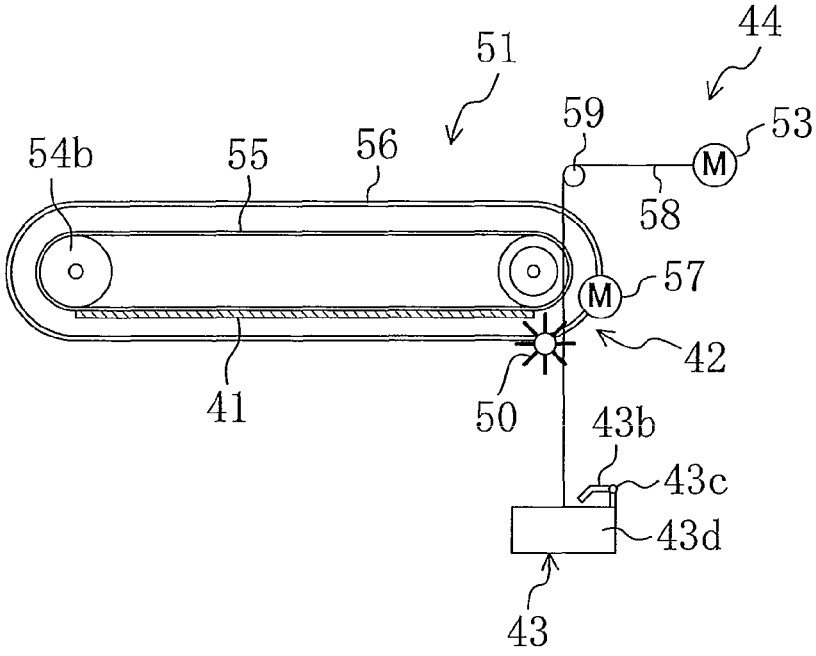
FIG. 4 is a side view illustrating a dust removing mechanism and a container lifting/lowering mechanism according to the embodiment of the present invention.

The dust container (43) is a member in the shape of a narrow container. In the dust container (43), as shown in FIG. 4, one of longitudinal side surfaces (43*a*) extending in the longitudinal direction is taller than the other. To a top end of the taller longitudinal side surface (43*a*), a proximal end of a top surface portion (43*b*) which is bent downward at a distal end thereof is attached with a shaft (43*c*) interposed therebetween. The top surface portion (43*b*) is rotatable about the shaft (43*c*).

A top end of the shorter longitudinal side surface (43*a*) and the distal end of the top surface portion (43*b*) form an opening therebetween. For example, in removing the dust accumulated in the dust container (43), the opening can be enlarged by rotating the top surface portion (43*b*) about the shaft (43*c*). Hanging parts for hanging wires (58) to be described later thereon are provided on lateral side surfaces (43*d*) extending in the lateral direction, respectively.

The dust container (43) can be lifted/lowered relative to the casing (34) by a container lifting/lowering mechanism (44) to be described later. When the dust container (43) is positioned in the casing (34), the dust container (43) is housed in the container housing part (20). In this state, a bottom surface of the dust container (43) is exposed in the room.

The dust removing mechanism (42) includes a rotating brush (50) as a brush member, a filter holding part (51), and a removing motor (57) serving as a drive mechanism. The rotating brush (50) includes a rod-like shaft, and a plurality of bristles attached to the circumference of the shaft. The rotating brush (50) is arranged in the top opening of the dust container (43) so that an axial direction of the shaft of the rotating brush (50) corresponds with the longitudinal direction of the dust container (43).

Figure 5:
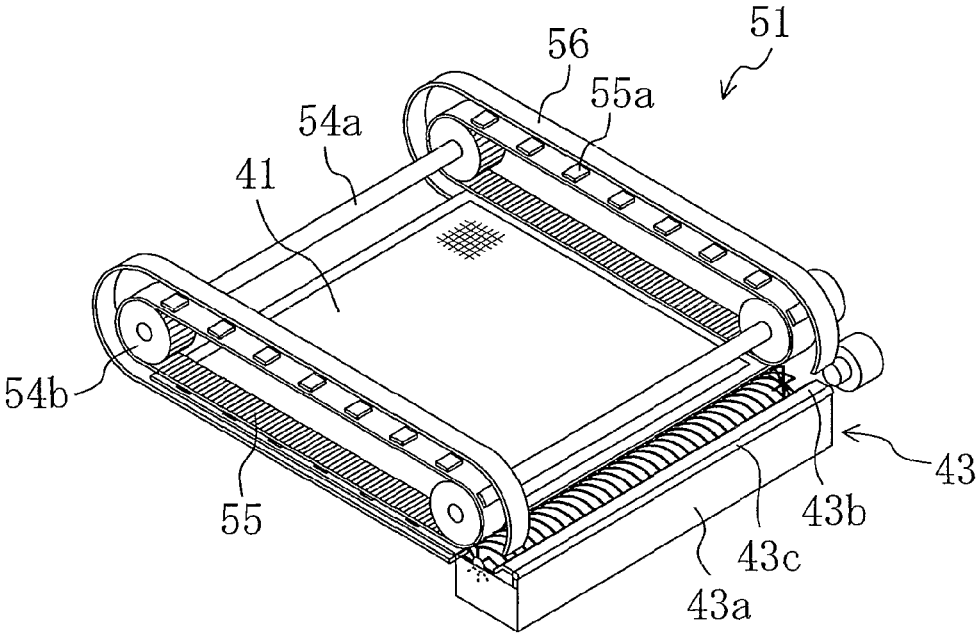
FIG. 5 is a perspective view illustrating a filter holding part according to the embodiment of the present invention as viewed from above.

The filter holding part (51) includes, as shown in FIG. 5, two pulleys (54), two drive belts (55), and two rail members (56). Each of the pulleys (54) includes a shaft (54*a*) and column-shaped rollers (54*b*) attached to the ends of the shaft (54*a*), respectively. A plurality of grooves are formed on an outer circumferential surface of each of the rollers (54*b*) so that they can engage with cogs on the drive belt (55) described later. The two pulleys (54) are arranged at an interval from each other so that the axial direction of their shafts (54*a*) coincides with the axial direction of the shaft of the rotating brush (50). One of the two pulleys (54) is positioned above the rotating brush (50). A pulley gear (not shown) is attached to the one of the pulleys (54). The pulley gear is formed to engage with a motor gear attached to a shaft of the removing motor (57).

Each of the drive belts (55) is a cogged belt provided with a plurality of cogs formed on an inner circumferential surface thereof. Each of the drive belts (55) is attached to the rollers (54*b*) on the same side of the pulleys (54) so that the cogs engage with the grooves on the rollers (54*b*). Attachment parts (55*a*) are formed on outer circumferential surfaces of the drive belts (55) so that a frame of the suction filter (41) is attached thereto. The suction filter (41) is attached to the drive belts (55) by engaging attachment parts on the frame of the suction filter (41) with the attachment parts (55*a*). The rail members (56) are arranged to surround the drive belts (55), respectively. The rail members (56) are in contact with the frame of the suction filter (41) so as to function as a guide of the suction filter (41). The drive belts (55) may be integral with the suction filter (41).

The container lifting/lowering mechanism (44) includes a lifting/lowering motor (53), and two wires (58). One end of each of the wires (58) is connected to a wire drum attached to a shaft of the lifting/lowering motor (53). The other ends of the wires (58) are connected to the hanging parts on the lateral side surfaces (43*d*) of the dust container (43), respectively. The wires (58) are hooked on a guide member (59) provided above the dust container (43), and they extend horizontally from the wire drum on the lifting/lowering motor (53) to the guide member (59), and extend vertically from the guide member (59) to the dust container (43). A single wire may be used as the wire (58). The wires (58) may be split in two or more at the other ends. Each of the other ends of the wires (58) is connected to the dust container (43).

In the air conditioner (10) of the present embodiment, every part of the suction filter (41) is positioned below the pulleys (54) during the heating and cooling operations, and dust contained in the air sucked through the inlet (22) is trapped on the suction filter (41). As the amount of the dust trapped on the suction filter (41) increases, air resistance of the suction filter (41) increases, thereby decreasing the efficiency of the air conditioner (10). Therefore, when the heating and cooling operations are stopped, the dust removing mechanism (42) performs dust removal operation of removing the dust trapped on the suction filter (41). The dust removal operation is performed, for example, when total operating time of the air conditioner (10) from the previous removal operation reaches a predetermined length.

In the dust removal operation, the removing motor (57) of the dust removing mechanism (42) is driven. When the removing motor (57) is driven, the pulleys (54) rotate, and the suction filter (41) moves. As the suction filter (41) moves, the dust adhered to the suction filter (41) is removed by the bristles of the rotating brush (50). The dust removed from the suction filter (41) falls and accumulates in the dust container (43).

The rotating brush (50) rotates as it is pushed by the suction filter (41). The dust adhered to the rotating brush (50) is removed as the tips of the bristles of the rotating brush (50) strike the distal end of the top surface portion (43*b*) of the dust container (43). The dust removed from the rotating brush (50) falls and accumulates in the dust container (43).

In the dust removal operation, the removing motor (57) keeps driving after every part of the suction filter (41) passes above the rotating brush (50). Then, when the suction filter (41) returns to the position below the pulleys (54), the removing motor (57) stops.

The air conditioner (10) of the present embodiment is provided with a detection sensor for detecting the amount of the dust in the dust container (43). For example, the detection sensor detects the amount of the dust in the dust container (43) by measuring the weight of the dust container (43). The air conditioner (10) is configured to display, for example, on a remote controller, that the dust container (43) requires cleaning, when the value detected by the detection sensor reaches or exceeds a predetermined value.

Further, the air conditioner (10) is configured so that the lifting/lowering of the duct container (43) can be commanded using a remote controller. When a user commands the lowering of the dust container (43), the wires (58) are unwound as the lifting/lowering motor (53) of the container lifting/lowering mechanism (44) rotates, and the dust container (43) is lowered. Then, when the user commands the lifting of the dust container (43) after the dust in the dust container (43) is removed, the wires (58) are wound as the lifting/lowering motor (53) rotates, and the dust container (43) is lifted. The air conditioner (10) is configured not to perform the dust removal operation during the lifting/lowering of the dust container (43).

Effect of the Embodiment

In the present embodiment, only the dust container (43) is lifted/lowered by the container lifting/lowering mechanism (44). Only the dust container (43) which is relatively lightweight is lifted/lowered.

In an indoor unit which is configured to lift/lower the suction grille member as disclosed by Patent Document 2, for example, the dust container can be lifted/lowered by integrating the suction grille member and the dust container. However, since the suction grille member is relatively heavy, the integration of the suction grille member and the dust container requires a complicated mechanism for lifting/lowering the suction grille member and the dust container.

Further, in the indoor unit which is configured to lift/lower the suction grille member as disclosed by Patent Document 2, the suction grille member is generally hung at two points to provide a simple structure. In this indoor unit, when the dust container is lifted/lowered together with the suction grille member, the dust container needs to be arranged, for example, in the center of the suction grille member, so as to prevent inclination of the dust container and dispersion of the dust contained in the dust container during the lifting/lowering of the suction grille member and the dust container. However, this structure may bring about a problem in that the dust container blocks the flow of air sucked through the suction grille member.

Further, when the dust container (43) is arranged at the edge of the suction grille member so as not to block the flow of air sucked through the suction grille member, the suction grille member has to be hung at three or more points to prevent the inclination of the dust container during the lifting/lowering. As a result, the structure for lifting/lowering the suction grille member and the dust container becomes complicated.

In contrast, according to the present invention, the container lifting/lowering means (44) lifts/lowers only the relatively lightweight dust container (43) without accompanied by the relatively heavy suction grille member. Specifically, power required for lifting/lowering the dust container (43) is relatively small. Since only the dust container (43) is lifted/lowered, for example, there is no need of considering members other than the dust container (43) so as to prevent the inclination of the dust container (43) and the dispersion of the dust in the dust container (43) during the lifting/lowering of the dust container (43). Therefore, the structure of the container lifting/lowering means (44) will not be complicated. Thus, a simple structure can be provided that allows for the lifting/lowering of the dust container (43) relative to the casing (34).

According to the present embodiment, the dust container (43) can be lifted/lowered by simply moving the dust container (43) in the vertical direction. This does not require complicated movement of the dust container (43), and therefore, the structure of the container lifting/lowering means (44) is simplified.

According to the present embodiment, the dust container (43) is arranged outside the inlet (22) on the bottom surface of the casing (34) without the outlet (23) interposed between the dust container (43) and the inlet (22). Specifically, the dust container (43) and the inlet (22) are adjacent to each other. This structure makes it possible to arrange the dust container (43) near the suction filter (41) arranged on the rear side of the inlet (22). Thus, the dust removed from the suction filter (41) can easily be guided to the dust container (43).

First Modified Example of Embodiment

Figure 6:
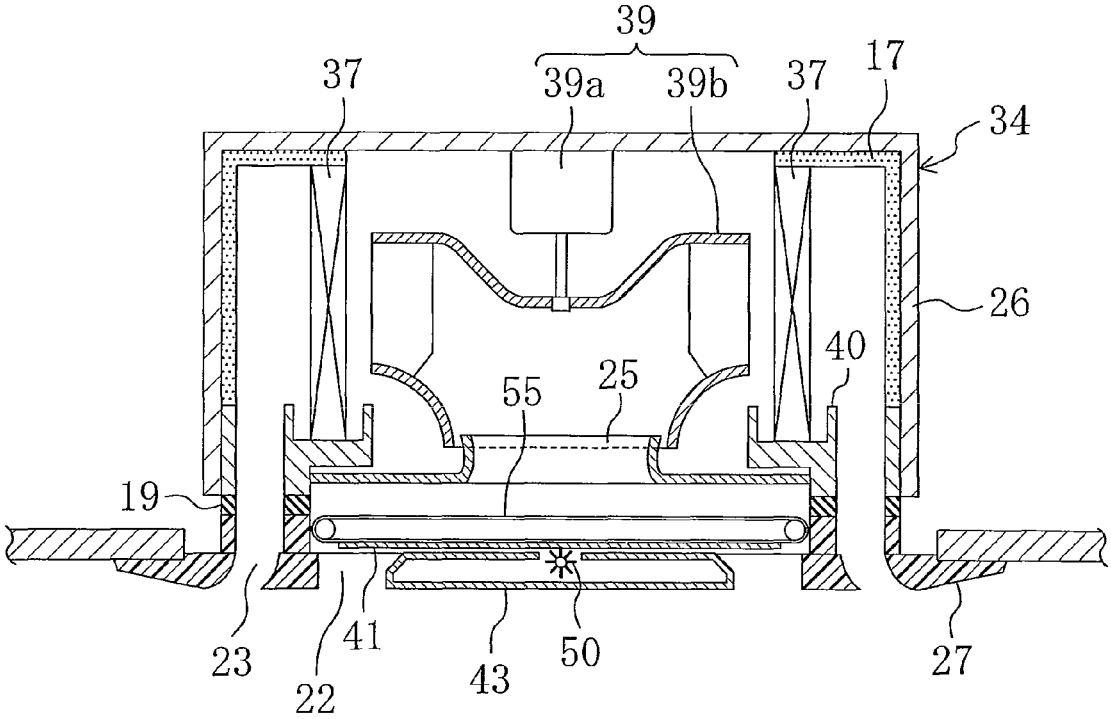
FIG. 6 is a cross-sectional view illustrating an indoor unit according to a first modified example of the embodiment of the present invention.
Figure 7:
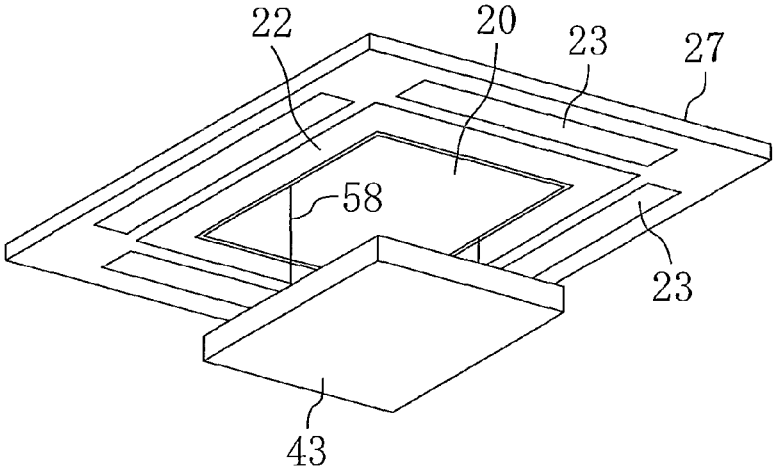
FIG. 7 is a perspective view illustrating a decorative panel according to the first modified example of the embodiment of the present invention as viewed from below.

A first modified example of the embodiment will be described below. According to the first modified example, as shown in FIGS. 6 and 7, the shape of the dust container (43) is different from that of the above-described embodiment.

Specifically, the dust container (43) is a flat-shaped container. The dust container (43) is rectangular-shaped when viewed in plan. This dust container (43) is provided with a narrow opening formed between two sides facing each other on the top surface thereof, and the rotating brush (50) is arranged near the opening.

The decorative panel (27) includes a container housing part (20) for housing the dust container (43) formed at the center thereof. The dust container (43), when positioned in the casing (34), exposes a bottom surface thereof in the room in the center of the decorative panel (27). In this decorative panel (27), the inlet (22) is formed around the dust container (43).

In the first modified example, the inlet (22) is formed around the dust container (43) in the bottom surface of the casing (34). That is, the dust container (43) and the inlet (22) are adjacent to each other. This structure makes it possible to arrange the dust container (43) near the suction filter (41) arranged on the rear side of the inlet (22). Thus, the dust removed from the suction filter (41) can easily be guided to the dust container (43).

Further, in the first modified example 1, the inlet (22) is formed near an outer edge of the decorative panel (27), so that relatively large space is saved for the dust container (43) in the center of the decorative panel (27). Therefore, the planar shape of the dust container (43) is enlarged so that the dust container (43) has a relatively large volume. Thus, a larger amount of dust can accumulate in the dust container (43).

Second Modified Example of Embodiment

Figure 8:
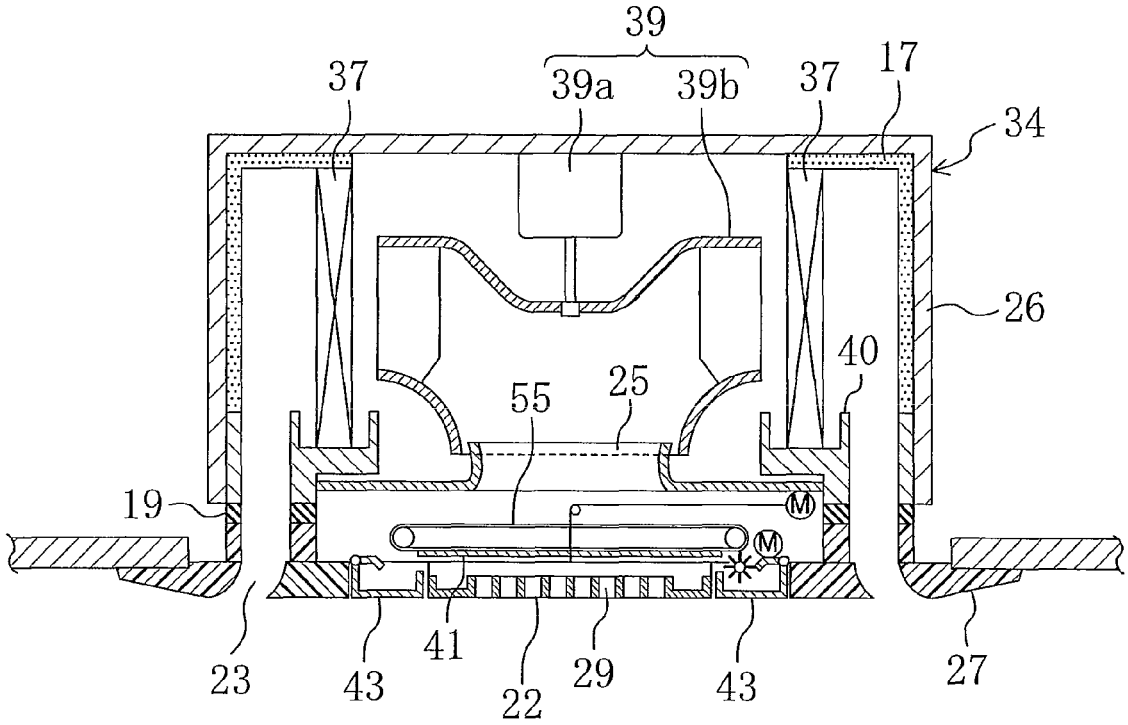
FIG. 8 is a cross-sectional view illustrating an indoor unit according to a second modified example of the embodiment of the present invention.
Figure 9:
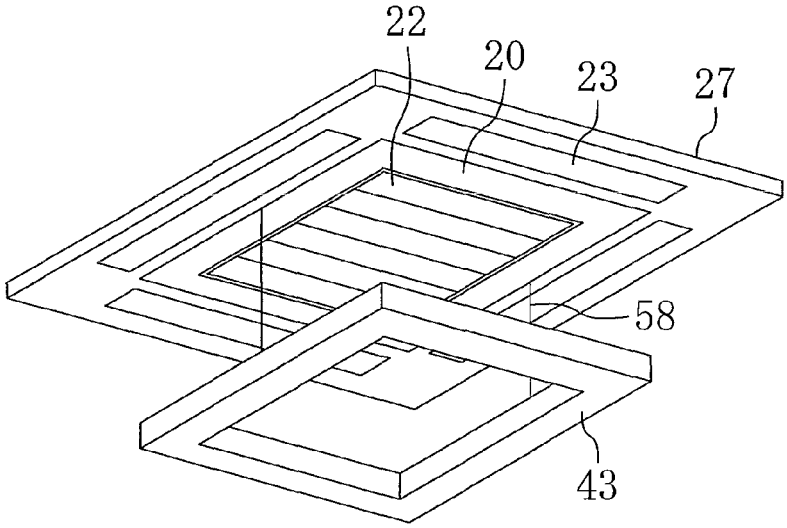
FIG. 9 is a perspective view illustrating a decorative panel according to the second modified example of the embodiment of the present invention as viewed from below.

A second modified example of the embodiment will be described below. In the second modified example, as shown in FIGS. 8 and 9, the shape of the dust container (43) is different from that of the above-described embodiment.

Specifically, the dust container (43) is in the shape of a hollow rectangle when viewed in plan, i.e., it is in the shape of a rectangular frame. The dust container (43) is provided with an opening formed along the entire circumference thereof between a top end of an inner side surface thereof and an inner end of a top surface portion extending from a top end of an outer side surface thereof. In the decorative panel (27), a container housing part (20) for housing the dust container (43) is formed around the inlet (22). The dust container (43), when positioned in the casing (34), surrounds the inlet (22), and exposes the bottom surface thereof in the room.

In the second modified example, a region on the bottom surface of the casing (34) between the inlet (22) and the outlet (23) surrounding the entire circumference of the inlet (22) is used to arrange the dust container (43). In the indoor unit (13), it is necessary to keep a certain distance between the inlet (22) and the outlet (23) so as to prevent a phenomenon in which the air blown from the outlet (23) is sucked through the inlet (22) (a so-called shortcut phenomenon). According to the second modified example, the region on the bottom surface of the casing (34) between the inlet (22) and the outlet (23) surrounding the entire circumference of the inlet (22) is effectively used for the dust container (43). This structure allows the dust container (43) to have a relatively large volume, and therefore, a larger amount of dust can accumulate in the dust container (43).

Third Modified Example of Embodiment

Figure 10:
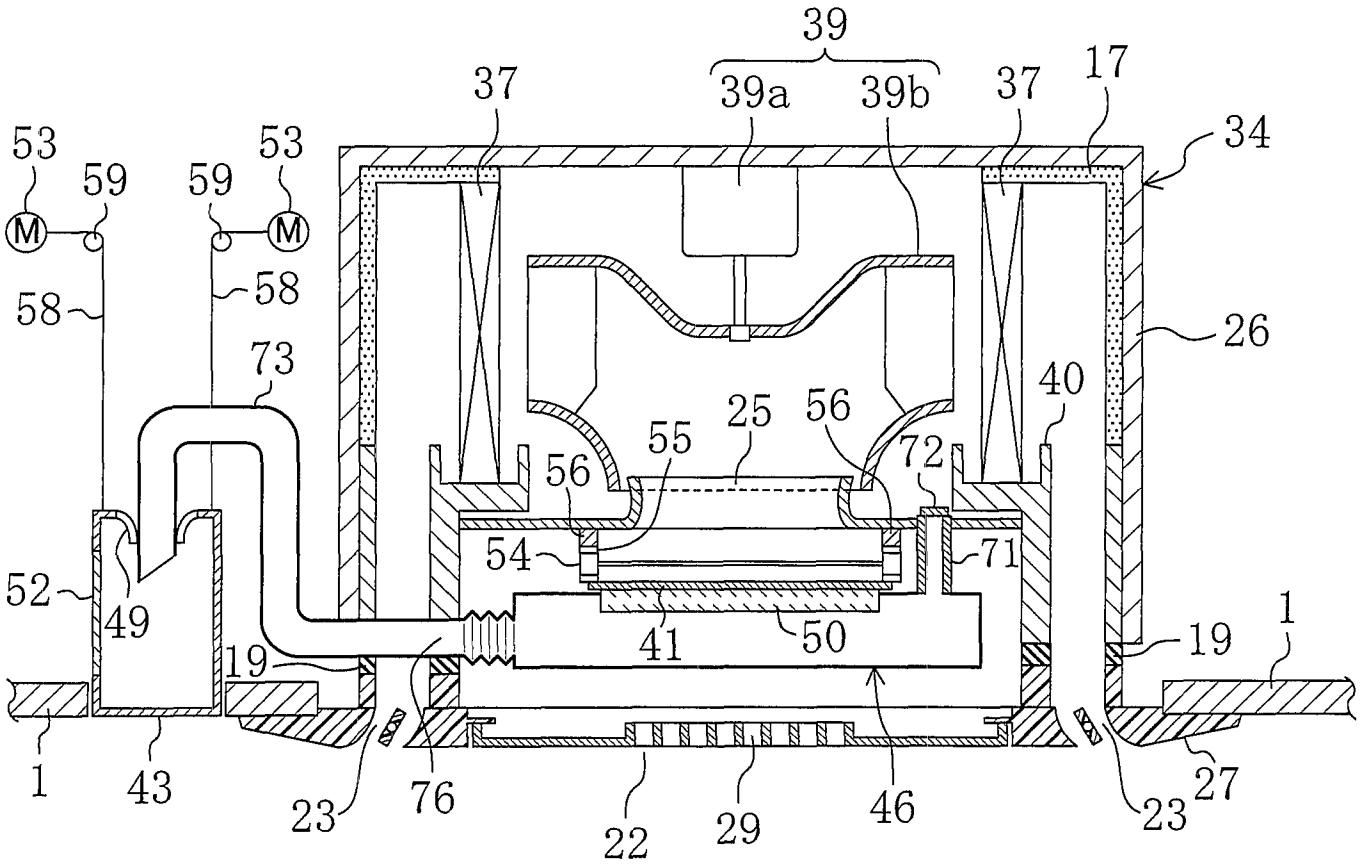
FIG. 10 is a cross-sectional view illustrating an indoor unit according to a third modified example of the embodiment of the present invention.

A third modified example of the embodiment will be described below. In the third modified example, as shown in FIG. 10, the arrangement of the dust container (43) is different from that of the above-described embodiment.

Specifically, the dust container (43) is arranged outside the casing (34). The dust container (43) is arranged in space above the ceiling so that its lower portion is inserted in with an opening in a ceiling board (1). In this state, a bottom surface of the dust container (43) is exposed in the room from a ceiling surface. The dust container (43) is suspended by the container lifting/lowering mechanism (44). The wires (58) of the container lifting/lowering mechanism (44) are connected to the dust container (43). The dust container (43) is lifted/lowered as the lifting/lowering motor (53) of the container lifting/lowering mechanism (44) rotates as described in the above-described embodiment.

Figure 11:
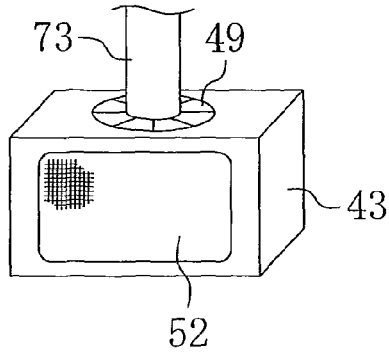
FIG. 11 is a perspective view illustrating a dust container according to the third modified example of the embodiment of the present invention.

As shown in FIG. 11, a top opening is formed in a top surface of the dust container (43) so that a transfer duct (73) described later is connected thereto. The top opening is provided with an anti-leakage member (49) for preventing the leakage of the dust from the dust container (43) through a gap around the transfer duct (73). The anti-leakage member (49) is made of eight fan-shaped rubber plates formed by radially cutting a disc plate. An arc-shaped part of each rubber plate is fixed to the rim of the top opening. The anti-leakage member (49) is configured so that the rubber plates bend inwardly when the transfer duct (73) described later is inserted into the top opening. Since the rubber plates bend in close contact with the transfer duct (73), almost no gap is formed around the transfer duct (73).

A side opening is formed in a side surface of the dust container (43) for evacuating the dust container (43) when the air is fed through the transfer duct (73). The side opening is provided with a filter (52).

In the third modified example, a transfer container (46) for sending the dust to the dust container (43) is arranged at the position where the dust container (43) of the above-described embodiment has been placed. The transfer container (46) is provided with a rotating brush (50). The rotating brush (50) is arranged so that the bristles are exposed from an opening formed in a top surface of the transfer container (46).

To one end of the transfer container (46), a guiding duct (71) is connected for guiding a flow of air generated by the indoor fan (39) into the transfer container (46). An inlet end of the guiding duct (71) communicates with space in which the indoor fan (39) is placed, and an open/close damper (72) is attached to the inlet end. The other end of the transfer container (46) is connected with a transfer duct (73) having an inlet end (76) made of a flexible tube. The transfer duct (73) is connected to the dust container (43) positioned on the ceiling. Specifically, the transfer duct (73) penetrates the casing (34). Outside the casing (34), the transfer duct (73) is bent and fixed by a fixing member which is not shown with an outlet end thereof facing downward. The outlet end of the transfer duct (73) is tapered.

In the third modified example, the damper (72) is opened, and the indoor fan (39) is operated during the dust removal operation. As a result, the air flow from the indoor fan (39) is guided to the transfer container (46) through the guiding duct (71), and the dust removed from the suction filter (41) by the rotating brush (50) is transferred to the dust container (43) by the air flow through the transfer duct (73). The transfer container (46) and the transfer duct (73) form a dust transfer path (46, 73).

The dust transfer may be performed after the dust removal operation. In this case, the dust removed in the dust removal operation accumulates in the transfer container (46) immediately after the dust removal operation. When the damper (72) is opened, and the indoor fan (39) is operated after the dust removal operation, the dust temporarily accumulated in the transfer container (46) is transferred to the dust container (43).

In the third modified example, the dust container (43) is lifted/lowered by a command sent through a remote controller as described in the above-described embodiment. In lowering the dust container (43), the transfer duct (73) is detached from the top opening of the dust container (43), and is separated from the dust container (43). In lifting the dust container (43), the transfer duct (73) is inserted into the top opening of the dust container (43), and is connected to the dust container (43).

In the third modified example, the dust removed from the suction filter (41) does not accumulate at a position where the removal is performed, but is transferred to the dust container (43), and then accumulates therein. Therefore, even when the dust fills the dust container (43), the dust does not have affect on the suction filter (41) and the dust removing mechanism (42). This structure improves the reliability of the indoor unit (1).

In the third modified example, the size of the dust container (43) is not limited by the size of the casing (34). Therefore, the dust container (43) can be enlarged.

In the third modified example, the transfer duct (73) is automatically detached from the dust container (43) as the dust container (43) is lowered, and is automatically connected to the dust container (43) as the dust container (43) is lifted. Therefore, the lowering of the dust container (43) does not involve a process of detaching the transfer duct (73) from the dust container (43). Further, after the dust container (43) is lifted, there is no need of performing a process of connecting the transfer duct (73) of the dust container (43). This allows for quick and easy lifting/lowering of the dust container (43).

In the third modified example, the dust container (43) is placed outside the casing (34). However, the dust container (43) may be placed at a corner of the casing (34). In this case, the dust removed from the suction filter (41) is transferred to the dust container (43) through a transfer path (46, 73) extending to the corner. Further, in the third modified example, the air flow generated by the indoor fan (39) is used to transfer the dust to the dust container (43). However, another fan for the dust transfer may be provided.

Other Embodiments

The above-described embodiment may be modified as described below.

First Modified Example

The motor-operated container lifting/lowering mechanism (44) for lifting/lowering the dust container (43) according to the above-described embodiment may be replaced with a mechanical mechanism which is configured to lift/lower the dust container (43) when a user rotates a handle, for example.

Second Modified Example

The dust removing mechanism (42) of the above-described embodiment may be configured so that the removing motor (57) rotates the rotating brush (50) instead of the pulley (54). In this case, the suction filter (41) moves as it is pushed by the rotating brush (50).

Both of the pulley (54) and the rotating brush (50) may rotate. In this case, a brush motor for rotating the rotating brush (50) is provided.

Third Modified Example

Figure 12:
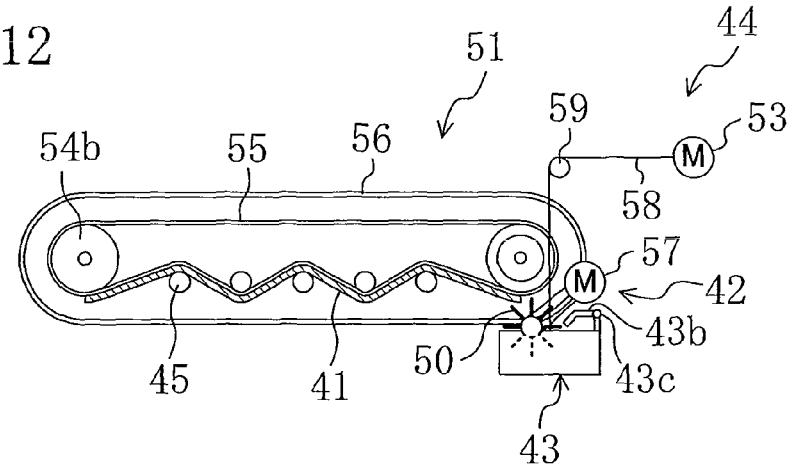
FIG. 12 is a side view illustrating a filter holding part according to a third modified example of the other embodiment.

In the above-described embodiment, as shown in FIG. 12, a plurality of guide rollers (45) may be provided between the pulleys (54) so that the suction filter (41) is supported in the corrugated shape by the guide rollers (45) during the heating and cooling operations. In this case, an area of the suction filter (41) can be increased as compared with that of the suction filter (41) of the above-described embodiment supported in the flat plate shape. Therefore, suppose that the same amount of the dust is trapped thereon, the amount of the adhered dust per unit area is reduced as compared with the suction filter of the above-described embodiment. This reduces air resistance of the suction filter (41).

Fourth Modified Example

Figure 13:
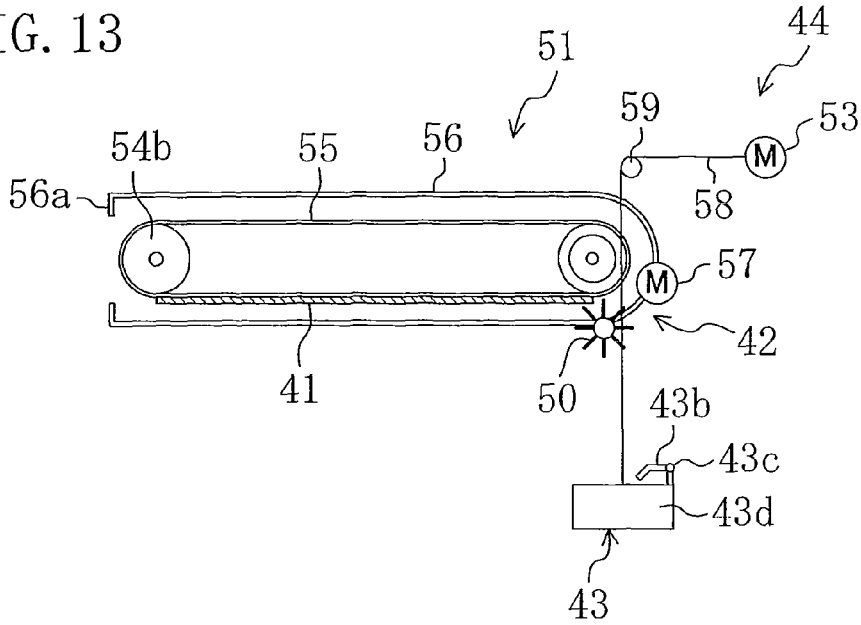
FIG. 13 is a side view illustrating a dust removing mechanism and a container lifting/lowering mechanism according to a fourth modified example of the other embodiment.

The filter holding part (51) of the dust removing mechanism (42) of the above-described embodiment may be configured to allow the suction filter (41) to make reciprocating movement instead of rotating movement. In this case, as shown in FIG. 13, the rail member (56) is not a continuous loop-shaped member, and is provided with a stopper (56*a*) at each of the ends thereof so as to prevent the filter holding part (51) from falling from the rail member (56).

Fifth Modified Example

The removing motor (57) of the dust removing mechanism (42) of the above-described embodiment may also function as the container lifting/lowering mechanism (44). Specifically, the removing motor (57) may be configured so that it can engage not only with the rotating brush (50) or the pulleys (54), but also with a wire drum (65) on which the wires (58) are wound.

Figure 14:
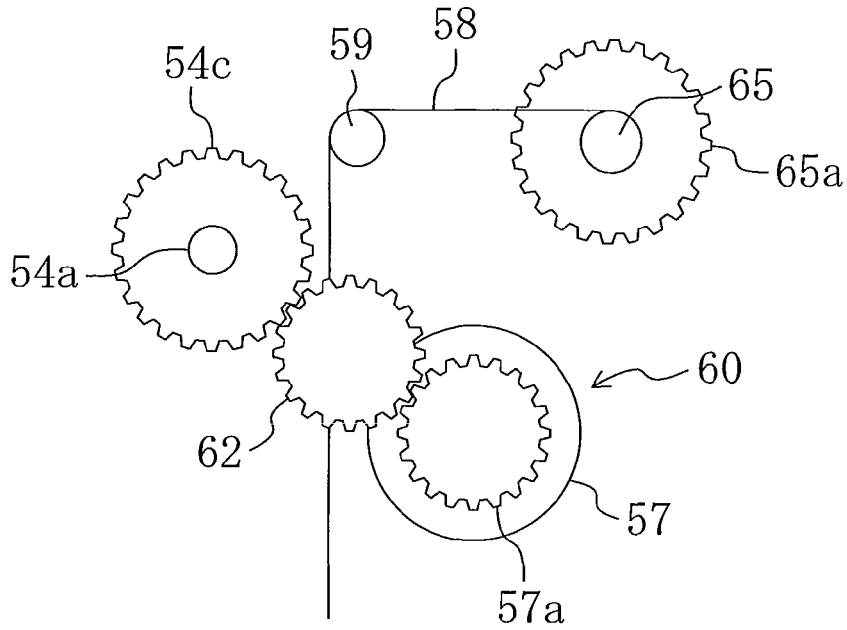
FIGS. 14A and 14B are schematic diagrams illustrating a dust removing mechanism and a container lifting/lowering mechanism according to a fifth modified example of the other embodiment.
Figure 14:
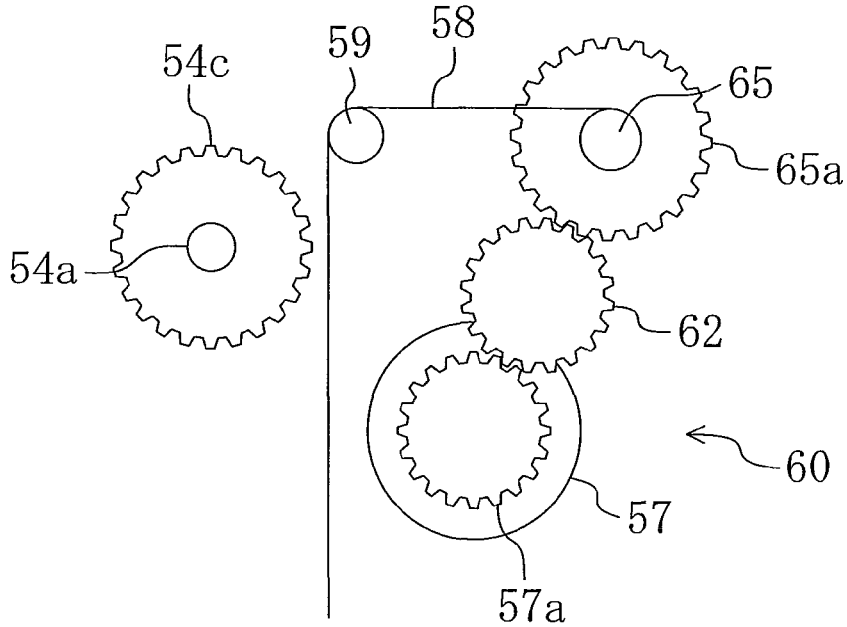

For example, FIG. 14 shows an example in which the removing motor (57) is configured to be able to engage with the pulley (54) and the wire drum (65). A motor gear (57*a*) is attached to a shaft of the removing motor (57), a lifting/lowering gear (65*a*) is attached to the wire drum (65), and a pulley gear is attached to a shaft (54*a*) of the pulley (54). The drive mechanism (60) includes a switching gear (62) and a switching motor in addition to the removing motor (57).

The switching gear (62) is supported by a gear support member (not shown) so that it can move between a first position (FIG. 14(A)) in which the switching gear (62) engages with both the motor gear (57*a*) and the pulley gear (54*c*), and a second position (FIG. 14(B)) in which the switching gear (62) engages with both the motor gear (57*a*) and the lifting/lowering gear (65*a*). In the dust removal operation, the switching motor moves the switching gear (62) to the first position. When the user commands the lowering of the dust container (43), the switching motor moves the switching gear (62) to the second position.

Sixth Modified Example

The above-described embodiment may be configured so that the dust removing mechanism (42) moves the rotating brush (50) from one end of the suction filter (41) to the other end to remove the dust adhered to the suction filter (41).

Seventh Modified Example

The above-described embodiment may be configured so that the dust removing mechanism (42) removes the dust from the suction filter (41) by sucking the dust. In this case, the dust removing mechanism (42) includes a suction fan.

Eighth Modified Example

The above-described embodiment may be configured so that the dust container (43) is arranged outside the casing body (26). This structure requires a means for transferring the dust removed from the suction filter (41) outside the casing body (26).

Ninth Modified Example

The indoor unit (13) of the above-described embodiment may be an indoor unit having the inlet (22) formed in a top plate or a side wall of the casing (34).

The embodiments described above are essentially preferable examples of the present invention, and they do not limit the present invention, an object to which the present invention is applied and use of the invention.

INDUSTRIAL APPLICABILITY

As described above, the present invention is useful for an indoor unit of an air conditioner installed on a ceiling.

The invention claimed is:

1. An indoor unit of an air conditioner installed on a ceiling, the indoor unit comprising:

a casing provided with an inlet on a first face of the casing and an outlet on the first face of the casing, the indoor unit controlling temperature of air sucked therein through the inlet, and blowing the air into a room through the outlet;

a filter member for trapping dust contained in the air sucked through the inlet;

a dust remover configured to remove the dust trapped on the filter member from the filter member;

a dust container for containing the dust removed from the filter member by the dust remover, said dust container including a base and side walls formed on the base; and a container lifting/lowering mechanism configured to lift and lower only the dust container relative to the casing in a vertical direction towards or away from the ceiling, wherein the lifting/lowering mechanism is attached to the indoor unit.

2. The indoor unit of the air conditioner of claim 1, wherein the dust container, when positioned in the casing, exposes a bottom surface thereof in the room from a bottom surface of the casing or a ceiling surface.

3. The indoor unit of the air conditioner of claim 2, wherein the inlet is formed in a center of the bottom surface of the casing, and the outlet is formed outside the inlet on the bottom surface of the casing, and the dust container, when positioned in the casing, lies on the bottom surface of the casing between the inlet and the outlet.

4. The indoor unit of the air conditioner of claim 3, wherein the dust container is in the shape of a rectangular frame when viewed from below, and the dust container, when positioned in the casing, surrounds the inlet.

5. The indoor unit of the air conditioner of claim 2, wherein the dust container, when positioned in the casing, lies in a center of the bottom surface of the casing, and the inlet is formed around the dust container.

6. The indoor unit of the air conditioner of any one of claims 1 to 5, wherein the dust remover includes a brush member for removing the dust adhered to the filter member, the brush member having an axis of rotation fixed relative to the casing, and a drive mechanism for rotating the brush member or moving the filter member to remove the dust adhered to the filter member, and the drive mechanism is configured to alternate between a first operation of moving the brush member or the filter member, a second operation of lifting/lowering the dust container where the drive mechanism functions as the container lifting/lowering mechanism.

7. An indoor unit of an air conditioner installed on a ceiling, the indoor unit comprising:

a casing provided with an inlet and an outlet, the indoor unit controlling temperature of air sucked therein through the inlet, and blowing the air into a room through the outlet;

a filter member for trapping dust contained in the air sucked through the inlet;

a dust remover configured to remove the dust trapped on the filter member from the filter member;

a dust container for containing the dust removed from the filter member by the dust remover, said dust container including a base and side walls formed on the base;

a container lifting/lowering mechanism configured to lift and lower only the dust container relative to the casing in a vertical direction towards or away from the ceiling;

a dust transfer path for transferring the dust removed from the filter member by the dust remover to the dust container; and a fan configured to generate a flow of air toward the dust container through the dust transfer path the flow of air transferring the dust removed from the filter member and flowed into the dust transfer path to the dust container, wherein the lifting/lowering mechanism is attached to the indoor unit.

8. The indoor unit of the air conditioner of claim 7, wherein the dust container is arranged in space above a ceiling outside the casing.

9. The indoor unit of the air conditioner of claim 7 or 8, wherein the dust container has a top opening formed in a top surface thereof to connect the dust transfer path thereto, the dust transfer path has an outlet portion made of a tube, and is arranged with the outlet portion facing downward, so that the outlet portion is inserted in the top opening when the container lifting/lowering means lifts the dust container, and that the outlet portion is detached from the top opening when the container lifting/lowering means lowers the dust container.

10. The indoor unit of the air conditioner of claim 7, further comprising:

a guiding duct connected to the dust transfer path; and a damper configured to selectively open and close the guiding duct, wherein opening of the damper causes the flow of air to transfer the dust along the dust transfer path to the dust container.

* * * * *